US008393184B2

(12) United States Patent
Lee et al.

(10) Patent No.: US 8,393,184 B2
(45) Date of Patent: Mar. 12, 2013

(54) DRUM TYPE WASHING MACHINE

(75) Inventors: Kyu Hwan Lee, Gyeongsangnam-do (KR); Hee Tae Lim, Gyeongsangnam-do (KR); Jae Hyun Choi, Gyeongsangnam-do (KR); Ig Geun Kwon, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 922 days.

(21) Appl. No.: 12/184,033

(22) Filed: Jul. 31, 2008

(65) Prior Publication Data

US 2009/0139274 A1 Jun. 4, 2009

(30) Foreign Application Priority Data

Aug. 3, 2007 (KR) ..... 10-2007-0078135

(51) Int. Cl.
*D06F 39/08* (2006.01)
*D06F 37/26* (2006.01)
*D06F 23/02* (2006.01)

(52) U.S. Cl. ..... 68/23.4; 68/142; 68/208

(58) Field of Classification Search ..... 68/142, 68/208, 23.4, 24
See application file for complete search history.

(56) References Cited

U.S. PATENT DOCUMENTS

| | | | | |
|---|---|---|---|---|
| 4,125,003 | A * | 11/1978 | Wasemann | 68/208 |
| 6,568,017 | B2 * | 5/2003 | Cheo et al. | 8/158 |
| 2006/0005583 | A1 * | 1/2006 | Park | 68/24 |
| 2006/0096336 | A1 * | 5/2006 | Sumida et al. | 68/23 R |

FOREIGN PATENT DOCUMENTS

| | | | |
|---|---|---|---|
| DE | 1 786 016 | U | 4/1959 |
| DE | 44 35 095 | A1 | 4/1996 |
| DE | 10 2005 032 045 | A1 | 2/2006 |
| KR | 10-2006-0089786 | A | 8/2006 |

* cited by examiner

*Primary Examiner* — Joseph L Perrin
(74) *Attorney, Agent, or Firm* — Birch, Stewart, Kolasch & Birch, LLP

(57) ABSTRACT

A drum-type washing machine is disclosed. The drum-type washing machine includes a case formed with an opening part for receiving therethrough laundry to be washed, a door opening and closing the opening part, a tub mounted in the case to receive wash water, a drum rotatably mounted in the tub, and a path compensation unit disposed at an inner lower end of the tub to facilitate flow of fluid while the drum is rotating. According to this drum-type washing machine, the dehydration efficiency can be improved.

15 Claims, 6 Drawing Sheets

DRUM TYPE WASHING MACHINE

This application claims the benefit of the Korean Patent Application No. 10-2007-0078135, filed on Aug. 3, 2007, which is hereby incorporated by reference as if fully set forth herein.

BACKGROUND OF THE INVENTION

1. Field of the Invention

The present invention relates to a drum type washing machine.

2. Discussion of the Related Art

Generally, washing machines can be classified into a top-loading type in which laundry to be washed is loaded through an upper part of a washing machine case, and a drum-type in which laundry to be washed is loaded through from a front opening part of a washing machine case.

A conventional drum-type washing machine generally comprises a case constituting an exterior appearance thereof, a door mounted to a front opening part formed at the case, a tub mounted inside the case to receive wash water, and a drum rotatably mounted inside the tub.

The drum receives the laundry to be washed and shares the wash water received in the tub through holes formed on an outer surface thereof. Washing of the laundry is performed as the drum is rotated by a driving unit of the washing machine.

The tub receives wash water therein so that the laundry received in the drum can be washed and rinsed. In addition, a drain system for discharging the wash water is formed at a lower end of the tub.

When the drum-type washing machine performs washing, the laundry to be washed is put into the drum through the door formed at the front of the case. Next, wash water is supplied to the tub and the drum is rotated such that the laundry can be washed by repeatedly rising and falling in the drum in accordance with rotation of the drum.

When the drum-type washing machine proceeds to a dehydrating operation, the drum spins at a high speed in the tub and therefore, wash water contained in the washed laundry is extracted out of the drum by a centrifugal force generated by the high-speed spinning of the drum. The wash water extracted out of the drum is discharged to the outside through the drain system formed at the lower end of the tub.

In the conventional drum-type washing machine, however, part of the wash water being extracted by the high-speed spinning of the drum may stay near the door, failing to drain through the drain system mounted at the lower end of the tub.

Especially, since fluid being circulated between the tub and the drum by rotation of the drum moves unstably at the lower end of the tub, the extracted wash water may also unstably move and splash toward the door instead of being favorably discharged through the drain system.

Furthermore, the extracted wash water may flow to the door along an inner surface of the tub, due to vibration generated from the rotating drum during the dehydrating operation.

When the extracted wash water splashes or flows toward the door as above, part of the extracted wash water fails to be discharged through the drain system and remains in a recessed part of the door or around a gasket mounted near the door. In this case, while the laundry which is washed and dehydrated is being taken out from the drum, the remaining water may soak into the laundry, thereby deteriorating the dehydration efficiency.

SUMMARY OF THE INVENTION

Accordingly, the present invention is directed to a drum-type washing machine that substantially obviates one or more problems due to limitations and disadvantages of the related art.

An object of the present invention is to provide a drum-type washing machine capable of preventing wash water from staying near a door during the operation thereof, so as to improve the dehydration efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum-type washing machine comprises a case formed with an opening part for receiving therethrough laundry to be washed, a door opening and closing the opening part, a tub mounted in the case to receive wash water, a drum rotatably mounted in the tub, and a path compensation unit disposed at an inner lower end of the tub to facilitate flow of fluid while the drum is rotating.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiment of the present invention, examples of which are illustrated in the accompanying drawings. Wherever possible, the same reference numbers will be used throughout the drawings to refer to the same or like parts.

Figure 1:
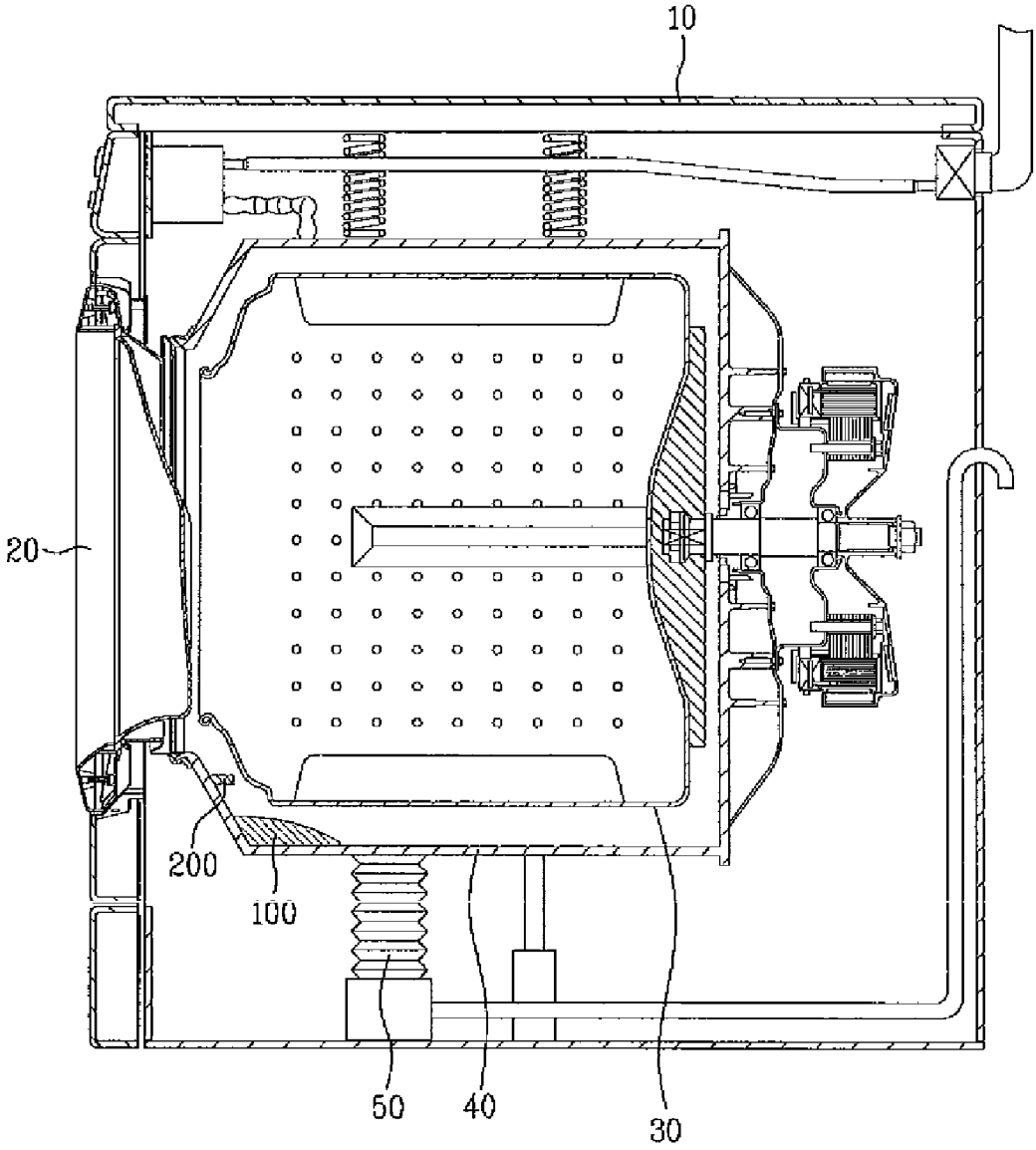
FIG. 1 a sectional view showing component parts provided in a drum-type washing machine according to an embodiment of the present invention.

FIG. 1 is a sectional view showing the inner structure of a drum-type washing machine according to an embodiment of the present invention.

Referring to FIG. 1, a case 10 constitutes an exterior appearance of the drum-type washing machine and includes an opening part for putting laundry to be washed therethrough. Also, a door 20 is mounted to open and close the opening part formed at the case 10.

In the drum-type washing machine, a tub 40 is mounted to receive wash water. Additionally, a drain system 50 is mounted to a lower end of the tub 40 to discharge the wash water to the outside.

The tub 40 includes a drum 30 which receives laundry to be washed therein. The drum 30 includes holes formed on an outer circumferential surface thereof so as to share the wash water received in the tub 40 through the holes. In addition, the drum 30 is rotatable in connection with a driving unit.

A path compensation unit 100 is provided at a lower end of the tub 40 to facilitate flow of fluid between the drum 30 and the tub 40 during rotation of the drum 30. An gathering water prevention unit 200 may be further provided to prevent wash water from flowing toward the door 20 along an inner surface of the tub 40.

The path compensation unit 100 and the gathering water prevention unit 200 will be described more particularly hereinafter.

Whereas the drum 30 usually has a substantially cylindrical shape, the tub 40 is shaped so that its longitudinal sectional area is enlarged at a lower end in comparison with an upper end. Therefore, an interval between the drum 30 and the tub 40 is increased from the upper end toward the lower end.

As the drum 30 is rotated, the fluid existing between the drum 30 and the tub 40, for example, the wash water or air containing the wash water, is moved along the outer circumferential surface of the drum 30. However, since a path of the fluid is suddenly expanded at the lower end as described above, flow of the fluid would be hindered.

Especially when the drum 30 is rotated at a high speed during a dehydrating operation, the fluid is moved very unstably. Therefore, the wash water around the drain system 50 mounted to the lower end of the tub 40 may also become unstable, accordingly splashing here and there.

The wash water splashed toward the door 20 may remain in a gasket or other recessed parts of the door 20, failing to be discharged through the drain system 50. In this case, the remaining wash water may soak into the laundry being collected after the washing and the dehydrating. Thus, the dehydration efficiency can be deteriorated.

To this end, the drum-type washing machine according to the embodiment of the present invention further comprises the path compensation unit 100 which helps the fluid flow more stably to thereby prevent the wash water from remaining near the door 20.

Figure 2:
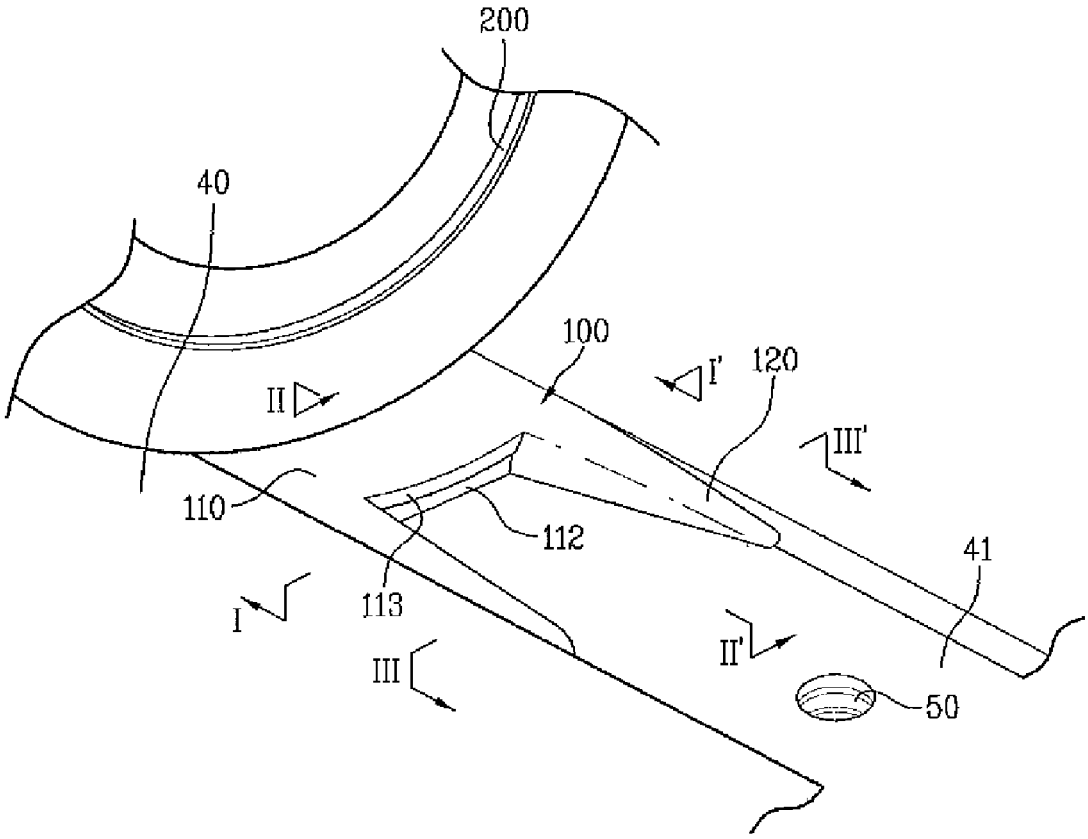
FIG. 2 is a perspective view of a path compensation unit of the drum-type washing machine of FIG. 1.

FIG. 2 is a perspective view of the path compensation unit of the drum-type washing machine.

As shown in FIG. 2, the path compensation unit 100 may be disposed at a front of an inner lower end 41 of the tub 40. As aforementioned, the path compensation unit 100 is formed to prevent splash of the wash water toward the door 20 which is caused due to the path configuration suddenly expanding at the lower end. Therefore, it is preferred that the path compensation unit 100 is mounted at the front of the inner lower end of the tub 40 in the vicinity of the door 20.

According to this embodiment, it is preferred that the path compensation unit 100 is capable of compensating for the interval between the tub 40 and the drum 30, the interval being expanded at the lower end 41, because the main factor that makes the fluid unstable at the lower end 41 of the tub 40 is the sudden expansion of the path caused by the tub 40 expanded at the inner lower end 41.

Therefore, the path compensation unit 100 compensates for the expansion of the path between the drum 30 and the tub 40 by narrowing the interval between the drum 30 and the tub 40, accordingly facilitating flow of the fluid near the door 20. As the flow of the fluid becomes smooth, the extracted wash water can be favorably discharged through the drain system 50.

Hereinafter, the configuration of the path compensation unit 100 adopted in the embodiment of the present invention will be described specifically.

The path compensation unit 100 comprises a main body 110 that compensates the interval between the tub 40 and the drum 30 being expanded at the inner lower end 41 at the front of the tub 40, and extension parts 120 extended from both sides of the main body 110 toward the rear side.

In order to compensate the expanded interval between the tub 40 and the drum 30, the main body 110 is connected to an inside of the tub 40 by a lower surface and lateral surfaces thereof as shown in FIG. 2. An upper surface of the main body 110 forms the path for the fluid. Also, the main body 110 forms a predetermined width parallel with a rotating shaft of the drum 30, thereby compensating the path within the predetermined width and facilitating the flow of the fluid.

When connected to the inner surface of the tub 40, the main body 110 is preferably connected in a curve form not to protrude toward the rotating shaft of the drum 30. If the main body 110 is protruded by any part when connected, the protruded part becomes an obstacle for the fluid circulating along the outer surface of the drum 30, thus hindering the flow of the fluid.

In this regard, an upper surface 111 of the main body 110 may be concavely curved by a predetermined curvature. More specifically, the upper surface 111 forms a compensated path through connection with the inner surface of the tub 40, such that the fluid passes through the path formed between the upper surface 111 and the drum 30. Therefore, it is preferred that the upper surface 111 of the main body 110 is in the form of a concavely curved surface so as to form the path advantageous for the fluid to circulate around the drum 30.

Figure 3:
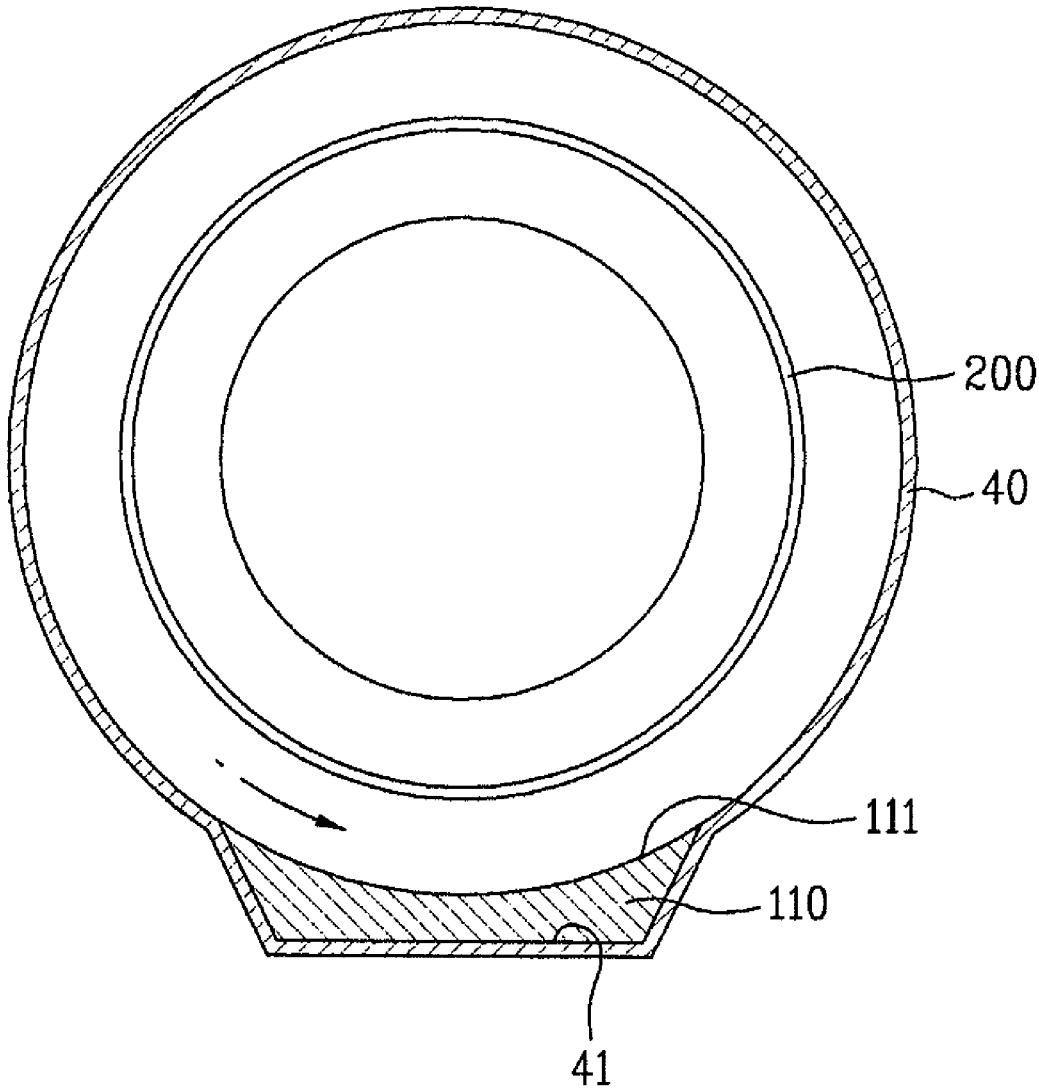
FIG. 3 is a sectional view of FIG. 2 cut along a line I-I'.

FIG. 3 is a sectional view of FIG. 2 cut along a line I-I'.

As shown in FIG. 3, more preferably, the upper surface 111 of the main body 110 accomplishes a uniform interval between the tub 40 and the drum 30 while forming the concave curve having the predetermined curvature. The optimum condition that secures the favorable flow of the fluid is uniform width and curvature of the path. Accordingly, when the inner surface of the tub 40 forms a concentric circle with the outer circumferential surface of the drum 30 by being compensated by the path compensation unit 100 as shown in FIG. 3, the width and the curvature of the path becomes uniform, thereby helping the fluid flow most favorably.

Figure 4:
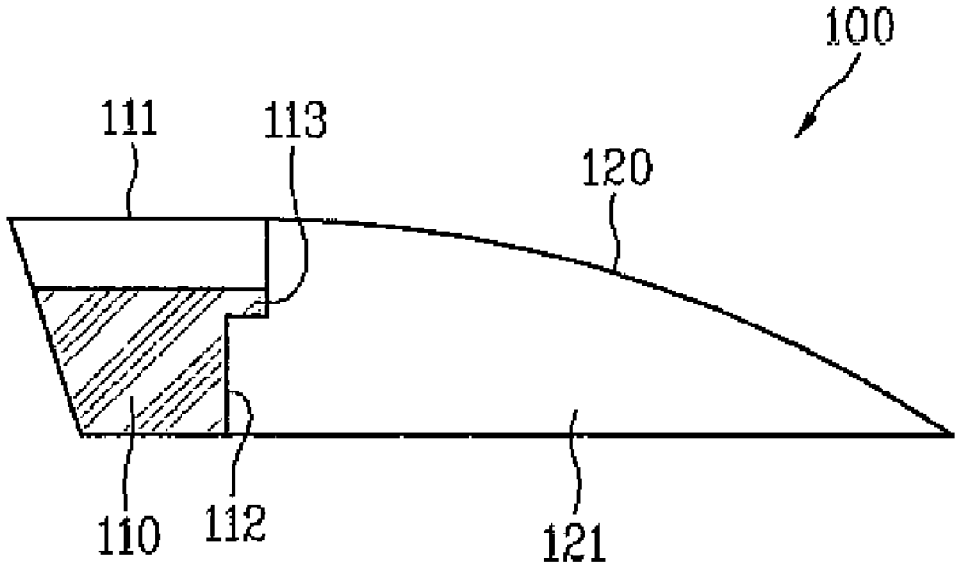
FIG. 4 is a sectional view of FIG. 2 cut along a line II-II'.

FIG. 4 is a sectional view of FIG. 2 cut along a line II-II'.

First of all, it is advised that the main body 110 of the path compensation unit 100 not only compensates the path but also obstructs the wash water flowing toward the door 20 along the inner lower end 41 of the tub 40.

The drum 30 of the drum-type washing machine is rotated by the driving unit (not shown) mounted at the rear side, and the extracted water may flow toward the door 20 along the inner surface of the tub 40 due to the vibration generated during the rotation of the drum 30. In case that the water flows to the door 20 passing by the drain system 50 at the inner lower end 41 of the tub 40, a rear surface of the main body 110 formed by a predetermined height at the front of the lower end of the tub 40 can obstruct flow of the water.

Here, it is preferred that the main body 110 includes a protrusion part 113 protruded from an upper end toward the rear side of the drum type washing machine. This is because, by providing the protrusion part 113 protruded toward the rear side, the water flowing toward the door 20 at the lower end 41 of the tub 40 is collided with a rear surface 112 of the path compensation unit 100 and therefore can be effectively prevented from splashing to the door 20.

Although the protrusion part 113 of this embodiment is protruded from the upper end to the rear side, the present invention is not limited to this configuration. For example, the rear surface 112 may have a concave shape or any other shape as long as being able to prevent the water from flowing toward the door 20.

In addition, according to the embodiment of the present invention, it is preferred that the path compensation unit 100 includes the extension parts 120 extended from both sides of the main body 110 toward the rear side. Since the extension parts 120 increase a connection area between the path compensation unit 100 and the tub 40, the connection between the path compensation unit 100 and the tub 40 can be stably maintained although friction and resistance are exerted to the path compensation unit 100 as the fluid existing between the drum 30 and the tub 40 rotates at a high speed.

The extension parts 120 extended from the both sides of the main body 110 are preferably attached and fixed to the inner surface of the tub 40. According to this embodiment, each of the extension parts 120 formed at both ends of the main body 110 is connected to a lower surface of the tub 40 through a side surface and a lower surface thereof.

Figure 5:
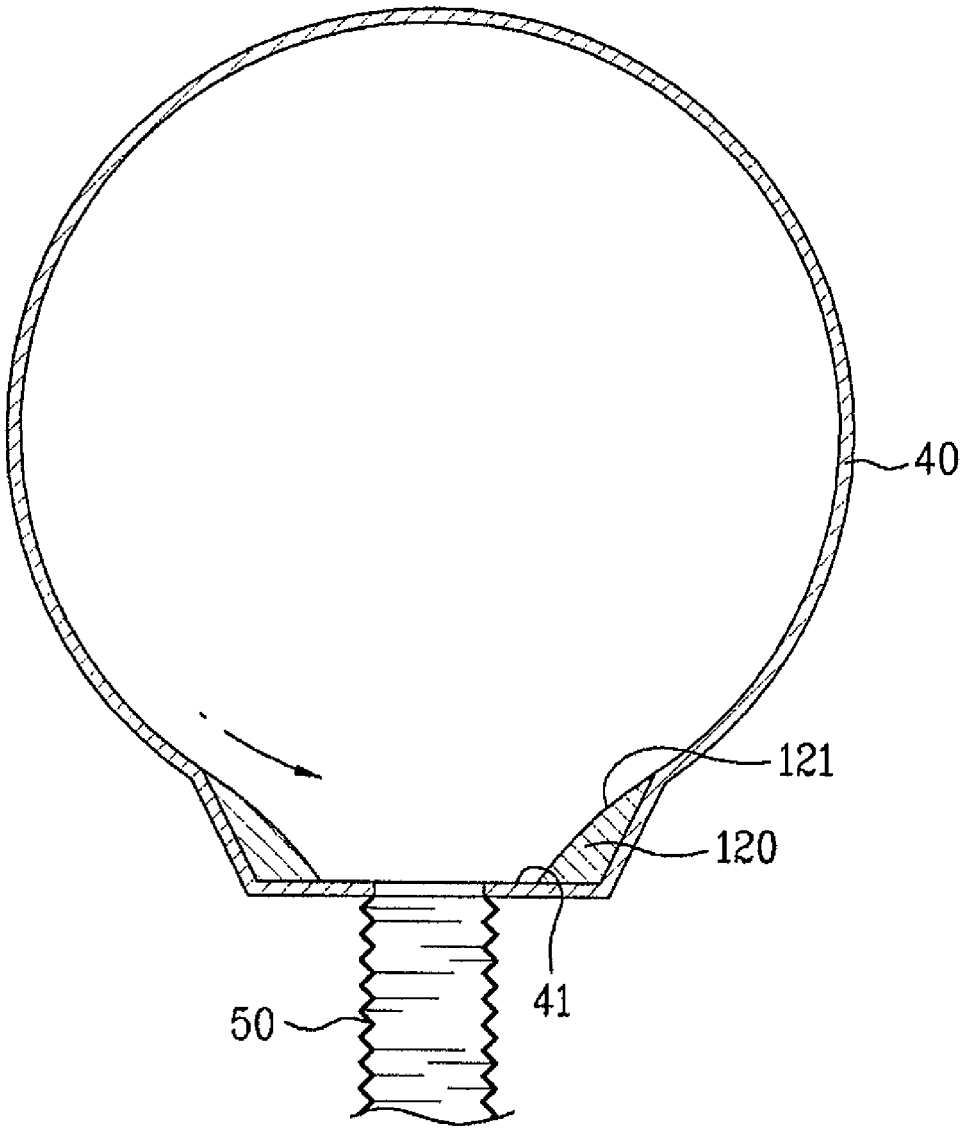
FIG. 5 is a sectional view of FIG. 2 cut along a line III-III'.

Referring to FIG. 5 which is a sectional view of FIG. 2 cut along a line III-III', an inner surface of the extension part 120 may be formed as a curved surface. If the extension part 120 has an angled corner to be protruded, resistance would be generated against the fluid rotating at a high speed during the dehydrating operation, thereby weakening the connection with the tub 40. Accordingly, the extension part 120 preferably has the curved inner surface so as to minimize the resistance against the fluid.

As well as improving the cohesion of the path compensation unit 100, the extension part 120 also enhances discharge of the extracted water through the drain system 50. During the dehydrating operation, the wash water extracted by the high-speed rotation of the drum 30 is also circulated along the inner surface of the tub 40. Here, the extracted water may fail to be discharged through the drain system 50 mounted at the lower end of the tub 40 due to inertia caused by the rotational circulation. To this end, the extension part 120 is mounted by a predetermined height to obstruct circulation of the water at the inner lower end 41 of the tub 40 such that the water being circulated can be obstructed by the extension part 120 and therefore easily discharged through the drain system 50.

Although the path compensation unit 100 according to the exemplary embodiment has been described so far, the present invention is not limited to this embodiment. For example, the path compensation unit 100 may not include the extension parts 120. In addition, the present invention may include the path compensation unit 100 capable of compensating the path by promoting an air flow between the drum 30 and the tub 40.

The drum-type washing machine according to the embodiment of the present invention may further comprise an gathering water prevention unit 200 mounted to the tub 40 to prevent the water in the tub 40 from flowing toward the door 20.

Figure 6:
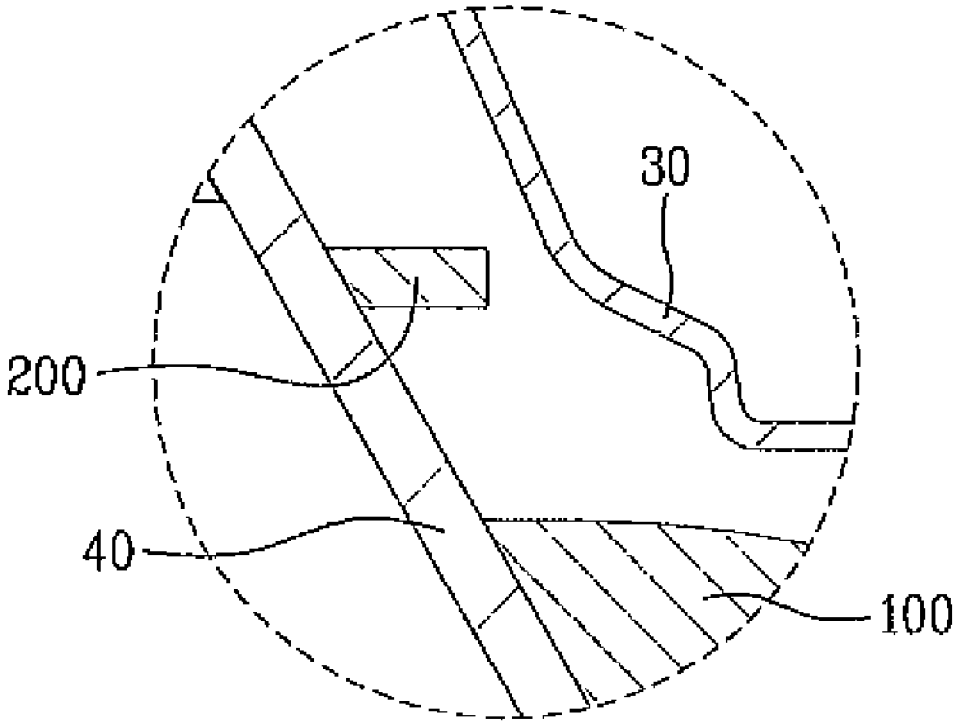
FIG. 6 is a sectional view of an gathering water prevention unit shown in FIG. 1.

FIG. 6 is a sectional view of the gathering water prevention unit 200 shown in FIG. 1. The gathering water prevention unit 200 will now be described in detail referring to FIG. 6.

As described above, when the drum 30 performs the high-speed spinning for the dehydrating operation, the water flows toward the door 20 along the inner surface of the tub 40. The laundry completed with washing and dehydrating may be soaked by the water remaining around the door 20 while being taken out from the drum-type washing machine. In order to prevent the dehydrating efficiency from thus being deteriorated, the gathering water prevention unit 200 prevents the water in the tub 40 from staying near the door 20.

More specifically, the gathering water prevention unit 200 is mounted near the door 20 in the tub 40, and more preferably disposed nearer to the door 20 than the path compensation unit 100. If the gathering water prevention unit 200 is disposed at a position where the flow of fluid is unstable between the drum 30 and the tub 40, the fluid such as the water still can splash to the door 20 due to the unstable movement in spite of obstruction by the gathering water prevention unit 200. Therefore, the gathering water prevention unit 200 needs to be mounted where the fluid can favorably flow.

It is also preferred that the gathering water prevention unit 200 comprises at least one rib 200 protruded along an inner circumference of the front part of the tub 40. (Since the rib is adopted as an example of the gathering water prevention unit 200, the same reference numeral as the gathering water prevention unit 200 is given to the rib.) The water extracted during the dehydrating operation flows along the inner circumference of the tub 40 throughout. Therefore, the rib 200 may have a circular shape to cover the whole inner circumference of the tub 40, that is, to prevent the water from all parts of the inner circumference of the tub 40 from flowing toward the door 20.

As shown in FIG. 6, the rib 200 is protruded, preferably inclining toward the rear side of the drum-type washing machine so as to effectively prevent the water flowing along the inner surface of the tub 40 toward the door 20 from splashing to the door 20 by collision with the rib 200.

Hereinafter, the dehydration processes in the drum-type washing machine of the present embodiment will be specifically described.

As the drum 30 receiving the laundry spins at a high speed, the wash water contained in the laundry is extracted to the outside of the drum 30. The water extracted from the drum 30 is supposed to be discharged through the drain system 50 mounted at the inner lower end 41 of the tub 40. However, part of the extracted water may flow as contained in the air or along the inner surface of the tub 40 according to the rotation of the drum 30.

In this case, at a rear part of the tub 40, the fluid such as the water or the air containing the water may move unstably and even splash because the path is suddenly expanded at the lower end 41 of the tub 40. However, at the front part of the tub 40, the fluid can stably flow by help of the path compensation unit 100. Accordingly, splash of the water toward the door 20 can be minimized.

Moreover, the water circulating along the inner circumference of the tub 40 is guided to the drain system 50 by the extension parts 120 of the path compensation unit 100, thereby being favorably discharged.

Also, the water flowing along the inner surface of the tub 40 toward the door 20 is obstructed by the rear surface 112 of the path compensation unit 100 and then guided to the drain system 50 by the extension parts 120. The water is also prevented from staying near the door 20 by the existence of the rib 200 disposed further at the front of the tub 40 than the path compensation unit 100.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum-type washing machine comprising:

a case formed with an opening part for receiving therethrough laundry to be washed;

a door opening and closing the opening part;

a tub mounted in the case to receive wash water;

a drum rotatably mounted in the tub; and a path compensation unit disposed at an inner front lower end of the tub to facilitate flow of fluid while the drum is rotating, wherein an inner surface of the tub and the path compensation unit form a continuous concentric surface with an outer circumferential surface of the drum at the inner front lower end of the tub, wherein the path compensation unit comprises:

a main body mounted to the inner front lower end of the tub in the vicinity of the door and connected to an inside of the tub by a lower surface and a lateral surface of the main body to compensate for an interval between the tub and the drum expanded at the inner front lower end of the tub; and an extension part formed at both sides of the main body and extended toward a rear side of the case for being attached and fixed to the inner surface of the tub, and wherein the main body includes a protrusion part protruded from an upper end thereof toward the rear side.

2. The drum-type washing machine according to claim 1, wherein an upper surface of the main body is in the form of a curved shape having a predetermined curvature.

3. The drum-type washing machine according to claim 2, wherein the upper surface of the main body is configured to make the interval between the tub and the drum uniform.

4. The drum-type washing machine according to claim 1, wherein an inner surface of the extension part is in the form of a curved surface.

5. The drum-type washing machine according to claim 1, further comprising a gathering water prevention unit that prevents water from flowing toward the door along an inner surface of the tub.

6. The drum-type washing machine according to claim 5, wherein the gathering water prevention unit comprises at least one rib protruded by a predetermined length along a front inner circumference of the tub.

7. The drum-type washing machine according to claim 1, wherein the path compensation unit is U-shaped.

8. A drum-type washing machine comprising:

a case formed with an opening part for receiving therethrough laundry to be washed;

a door opening and closing the opening part;

a tub mounted in the case to receive wash water;

a drum rotatably mounted in the tub;

a channel formed in the bottom of the tub, the channel having a bottom wall and two side walls;

a drain in the channel; and a path compensation unit disposed in the channel at an inner front lower end of the tub to facilitate flow of fluid while the drum is rotating, wherein an inner surface of the tub and the path compensation unit form a continuous concentric surface with an outer circumferential surface of the drum at the inner front lower end of the tub, and wherein the path compensation unit comprises:

a main body having a width equal to a width of the channel; and a pair of extension parts extending from the main body part and extending toward the drain.

9. The drum-type washing machine according to claim 8, wherein a height of the main body is equal to a depth of the channel.

10. The drum-type washing machine according to claim 9, wherein a height of the pair of extension parts decreases as the pair of extension parts extend from the main body.

11. The drum-type washing machine according to claim 8, wherein the main body has a central portion located between the pair of extension parts, and a protrusion extending from the central portion and extending toward the drain.

12. The drum-type washing machine according to claim 8, wherein a top wall of the main body is arcuate.

13. The drum-type washing machine according to claim 8, wherein each of the pair of extension parts has a first wall contacting the channel bottom wall, a second wall contacting the channel side wall and a third wall extending between the first and second walls.

14. The drum-type washing machine according to claim 13, wherein the third wall is arcuate.

15. The drum-type washing machine according to claim 8, wherein the path compensation unit is U-shaped.

* * * * *